US005090328A

United States Patent [19]

Theis et al.

[11] Patent Number: 5,090,328

[45] Date of Patent: Feb. 25, 1992

[54] SPIN STABILIZED PROJECTILE UNIT

[75] Inventors: Ulrich Theis, Mülheim; H. -P. Hellmeister, Erkrath; Bernhard Bisping, Ratingen; Michael Vagedes, Düsseldorf; Siegfried Kebler, Düsseldorf; Horst Kantner, Düsseldorf; Peter Sommer, Ratingen, all of Fed. Rep. of Germany

[73] Assignee: Rheinmetall GmbH, Düsseldorf, Fed. Rep. of Germany

[21] Appl. No.: 749,705

[22] Filed: Aug. 26, 1991

[30] Foreign Application Priority Data

Aug. 25, 1990 [DE] Fed. Rep. of Germany ..... 4026902

[51] Int. Cl.[5] ..... F42B 14/06

[52] U.S. Cl. ..... 102/522

[58] Field of Search ..... 102/520–523

[56] References Cited

U.S. PATENT DOCUMENTS

| | | | |
|---|---|---|---|
| 3,496,869 | 2/1970 | Engel | 102/522 |
| 3,507,221 | 4/1970 | Grolly | 102/523 |
| 4,476,785 | 10/1984 | Hoffman et al. | 102/522 |
| 4,982,669 | 1/1991 | Bisping et al. | 102/522 |

FOREIGN PATENT DOCUMENTS 2131084 12/1972 Fed. Rep. of Germany .

*Primary Examiner*—Harold J. Tudor

*Attorney, Agent, or Firm*—Spencer & Frank

[57] ABSTRACT

A spin stabilized projectile unit includes a sub-caliber projectile having a cylindrical section connected to a conical tail section including an external circumferential holding groove. A propelling cage casing encloses the projectile. A propelling base includes a receptacle holding the projectile and connected with the projectile and the propelling cage casing. The receptacle includes inwardly projecting axial webs presenting an inner diameter of the receptacle in a region of the cylindrical section of the projectile which corresponds to the outer diameter of the cylindrical section. The inner diameter of the receptacle formed by the webs becomes increasingly larger than the respective outer diameter of the conical section beginning in the transition region between the cylindrical and conical sections to form an annular gap extending to a bottom region of the bottom of the receptacle. A segmented holding ring is disposed between the inner diameter of the receptacle and the outer diameter of the conical tail section and lies in the holding groove and against the inner diameter of the receptacle for holding the projectile in the receptacle of the propelling base.

7 Claims, 1 Drawing Sheet

SPIN STABILIZED PROJECTILE UNIT

BACKGROUND OF THE INVENTION

The present invention relates to a spin stabilized projectile unit including a sub-caliber projectile, a propelling cage casing enclosing the projectile, and a propelling base surrounding the projectile and connected to the projectile and the propelling cage casing, wherein the projectile is held in a receptacle of the propelling base by a holding ring.

Projectile units of this type are employed, for example, in the form of cartridge ammunition in automatic weapons and are fired from rifled gun barrels. In modern ammunition of this type, a relatively heavy projectile body is used as the projectile, often composed of heavy metal alloys and held by a sleeve-shaped propelling cage casing usually made of plastic and in a propelling base, frequently made of a light metal and connected with the propelling cage casing.

In practice, it has been found that the propelling cage casing undesirably bursts open prematurely or that damage can occur to the projectile core itself, particularly if the latter is made of a brittle material. This can happen if, during the automatic, cadenced loading along a loading path having a bend, the cartridge hits the end of the gun barrel when entering the cartridge chamber and is delayed. This occurs more frequently with increasingly faster cadence in continuous fire and concomitant developing deceleration forces which are insufficiently absorbed for reliable support of the projectile core.

Various solutions are disclosed in the prior art for projectiles of this type in order to overcome the foregoing problems. For example, German Auslegeschrift [published German Patent Application] No. 2,131,084 discloses a sub-caliber projectile which is seated in a receptacle formed by a propelling base and is surrounded by a propelling cage casing that is connected with the propelling base. The projectile itself is provided with an external groove in its tail section into which a holding ring is inserted so as to force-lockingly fix the projectile in the receptacle in that it engages in an internal groove in the receptacle. The holding ring, in turn, is composed of a coiled tension spring whose interior accommodates a spring steel ring which serves as its core.

In the projectile according German Auslegeschrift No. 2,131,084, the purported favorable effects of the coil spring holding ring during the loading of such ammunition are opposed by considerable drawbacks in the external ballistic behavior of the projectile. Since the coil spring holding ring has a throughgoing bore and the receptacle in the propelling base is provided as a throughgoing ring, the release of the propelling cage from the projectile body after leaving the gun barrel without a pendulum action is not ensured. Additionally, the release occurs only several meters beyond the gun barrel muzzle due to the configuration of the receptacle. Moreover, the rather complicated structure of a steel spring ring as the core and the annular coil spring pulled around it require a relatively large exterior cross section for the entire ring. This necessitates a relatively deep exterior groove in the tail section of the projectile which is unfavorable from a flow technology point of view. Further, because the groove in the tail section of the projectile of German Auslegeschrift No. 2,131,084, is disposed directly behind (when seen in the direction of flight) a cylindrical section of the projectile, the trajectory of the projectile will in almost all cases be adversely affected once the projectile leaves the gun barrel and the propelling cage casing and propelling base have been released.

Additionally, according to the illustration in FIG. 1 of German Auslegeschrift No. 2,131,084, it appears possible that strong deceleration forces during loading will cause the holding ring in its holding groove in the receptacle to be widened radially outwardly to such an extent that the projectile body becomes quasi-freely movable and, as a result of its inertia, destroys the propelling cage casing.

Another drawback of the projectile unit disclosed in German Auslegeschrift No. 2,131,084 is that the required relatively deep exterior groove on the projectile tail results in an undesirable notch effect which has an adverse influence during loading, particularly if brittle materials are employed for the projectile.

SUMMARY OF THE INVENTION

It is therefore an object of the present invention to provide a projectile which is improved over prior art projectiles of the same type, which permits the use of a brittle material for the projectile and ensures reliable fixing of the projectile body in the propelling base even if the loading path is bent and loading occurs at a fast cadence during continuous fire.

It is a further object of the invention to provide a projectile of the type described above in which a holding ring is employed which is manufactured easily and ensures a reliable release directly outside of the gun barrel nozzle without adversely affecting the external ballistic effect of the projectile.

The above and other objects are accomplished according to the invention by the provision of a spin stabilized projectile unit, comprising: a sub-caliber projectile including a cylindrical section with an outer diameter, a conical tail section including an external circumferential holding groove and having an outer diameter, and a transition region connecting the cylindrical section to the conical section; a propelling cage casing enclosing the projectile; a propelling base including a receptacle in which the projectile is seated and being connected with the projectile and the propelling cage casing, the receptacle including inwardly projecting axial webs presenting an inner diameter of the receptacle in a region of the cylindrical section of the projectile which corresponds to the outer diameter of the cylindrical section, the inner diameter of the receptacle formed by the webs becoming increasingly larger than the respective outer diameter of the conical section beginning in the transition region to form an annular gap extending to a bottom region of the receptacle; and a segmented holding ring disposed between the inner diameter of the receptacle and the outer diameter of the conical tail section and lying in the holding groove and against the inner diameter of the receptacle for holding the projectile in the receptacle of the propelling base.

A particular advantage of the arrangement according to the invention is that the holding groove in the conical tail section of the projectile does not interfere in any way with the flow behavior of the projectile once the propelling cage casing, the propelling base and the holding ring have been released after the projectile unit leaves the gun barrel. Therefore, the trajectory, and thus the external ballistic behavior of the projectile remain unaffected.

The receptacle according to the invention, which widens conically in the propelling base relative to a conically tapering projectile tail, permit the introduction of the holding ring without weakening the wall thickness of the receptacle. The wall thickness of the receptacle itself may therefore be kept very slight, thus permitting a larger projectile diameter to be realized for the same exterior dimensions of the propelling cage casing.

The friction-lock contact of the receptacle produced by the present invention in the forward region of the receptacle at the cylindrical part of the projectile additionally reinforces the fixation of the projectile effected by the holding ring in the receptacle.

The holding ring according to the invention, is a "simple" ring composed, preferably, of two segments, is easy to manufacture and, due to its segmentation, permits problem-free release from the projectile under the influence of centrifugal forces. Since this release occurs simultaneously in all regions of contact with the holding groove in the conical section of the projectile tail, no pendulum moment is transmitted to the projectile even at the instant of release, so that here again the external ballistic behavior of the projectile is not adversely affected.

According to a further feature of the invention the segmented holding ring is made of spring steel. The elastic properties of the spring steel are thus utilized to provide support to the release effect of the holding ring segments. A further advantageous feature of the invention, particularly for larger calibers, provides that the holding ring be given an angular cross section. Thus, it is possible to set the desired holding forces on the basis of the large projectile masses to be expected and on the basis of the easily predeterminable contact surfaces for the holding ring.

As a further advantageous feature of the invention, a holding ring is provided which has a small round cross section which offers the advantage that only one holding groove whose depth is relatively shallow need be provided in the projectile tail section so that here again the external ballistic behavior of the projectile can additionally be improved.

The invention will now be explained and described in greater detail with reference to the accompanying drawing figures.

DETAILED DESCRIPTION OF PREFERRED EMBODIMENTS

Figure 1:
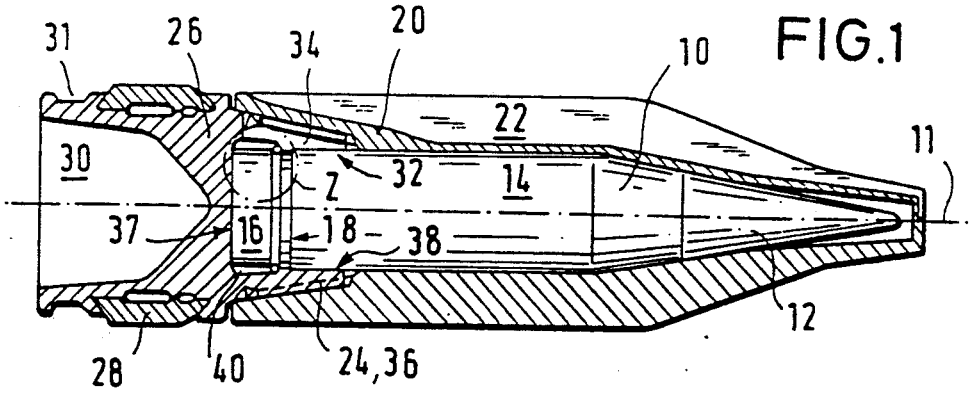
FIG. 1 is a longitudinal sectional view of a spin-stabilized projectile according to the invention.

Referring to FIG. 1, there is shown a projectile unit, in accordance with the invention, which includes a projectile 10 enclosed in a propelling cage casing 20 and seated in a propelling base 26.

Projectile 10 has a longitudinal axis 11, and includes a nose section 12, a cylindrical section 14 and a tapering conical tail section 16. Conical section 16 and cylindrical section 14 of projectile 10 are connected by way of a transition region 18. Preferably, projectile 10 is composed of a brittle metal material as is known in the art.

In its nose section 12 and in its cylindrical section 14, projectile 10 is surrounded by propelling cage casing 20 which is preferably produced from a plastic material. Propelling cage casing 20 encloses the cylindrical section 14 of projectile 10 and the beginning of its nose section 12 as tightly as possible.

Propelling cage casing 20 is provided in a known manner with slot-shaped recesses 22 along its longitudinal axis so that a clean release of propelling cage casing 20 from projectile 10 is ensured immediately after leaving the gun barrel (not shown).

The inner diameter of propelling cage casing 20 is widened in its rearward region and is there provided with an internal thread 24 for connection with a propelling base 26.

A circumferential groove, not identified here, is disposed on the circumference of propelling base 26 and accommodates a sealing and rotating band 28. A recess 30 at the tail end of propelling base 26 serves to save weight and, due to its configuration, supports the sealing effect of sealing and rotating band 28 when firing gases penetrate through it. Propelling base 26 is additionally provided with a known choke groove 31 to fix itself in a cartridge casing (not shown here).

Projectile 10 is held in a receptacle 32 of propelling base 26 by a holding ring and reinforced by a friction locking region 38. Receptacle 32 itself is composed of a cup-shaped sleeve which is divided into individual webs 34 by cuts along its longitudinal axis. Webs 34, in turn, are provided with a circumferential external thread 36 which corresponds with the internal thread 24 of propelling cage casing 20.

The rear end face (not identified in detail here) of projectile 10 which is seated in receptacle 32 lies against the corresponding end face at the bottom of receptacle 32. A form-locking zone 37 is provided between conical tail section 16 of projectile 10 and propelling base 26, to ensure, by suitable known means disposed at projectile 10 and at propelling base 26, respectively, the transfer of spin from propelling base 26 to the projectile.

The inner diameter of receptacle 32 formed by webs 34 increases from transition region 18 downwardly toward the bottom of receptacle 32 and thus forms, in cooperation with conical tapering tail section 16 of projectile 10, a downwardly enlarged annular gap or conical region 40 having an increasing inner diameter toward the bottom of the receptacle.

Preferably, propelling base 26 and receptacle 32 fastened thereto are made of a single piece of light metal, for example aluminum.

Figure 2:
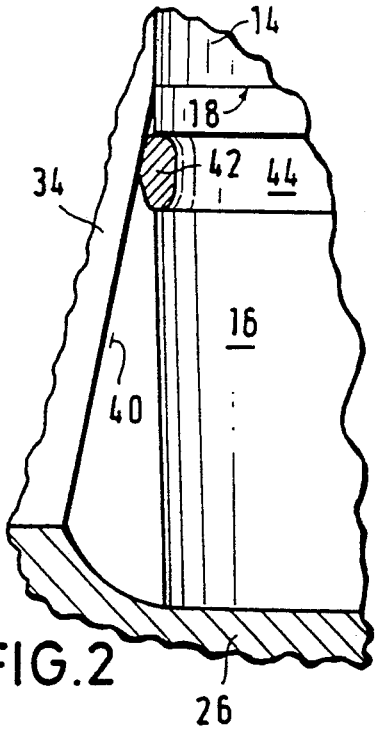
FIG. 2 is an enlarged sectional view of a detail marked Z in the projectile of FIG. 1 showing a first embodiment of a holding ring according to the invention.
Figure 3:
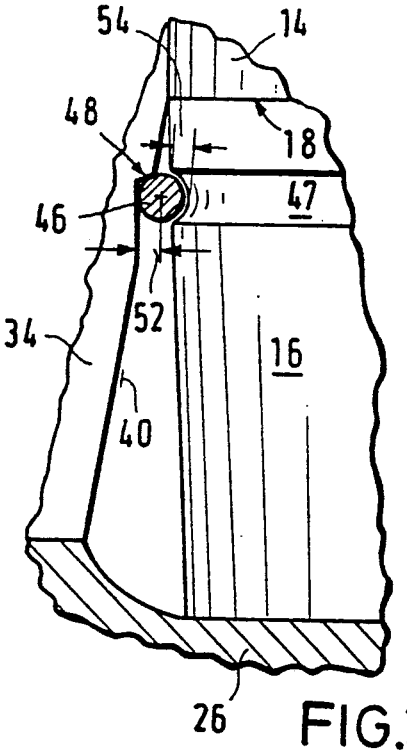
FIG. 3 is an enlarged sectional view of a detail of the projectile of FIG. 1 showing a second embodiment of a holding ring according to the invention.

FIGS. 2 and 3 show two embodiments of a holding ring 42 and 46, respectively, as an enlarged illustration of the detail marked Z in FIG. 1. These figures are exemplary, as other embodiments of the holding ring are conceivable without limiting the scope of the invention.

Holding ring 42 shown in FIG. 2 is preferably made of spring steel and has a generally trapezoidal cross-sectional shape whose base is rounded considerably. Holding ring 42 is inserted into a circumferential holding groove 44 provided on the outer circumference of conical tail section 16 of projectile 10. Holding ring 42 has a conical exterior face which lies against the interior wall of receptacle 32 formed by webs 34 in the region of annular gap 40 thus forming a force-locking connection. On the basis of this force-locking connection, holding ring 42 reliably fixes projectile 10 in receptacle 32 of propelling base 26 against all damaging forces during loading of the ammunition.

In contrast to holding ring 42 shown in FIG. 2, holding ring 46 shown in FIG. 3 has a round cross section. It is likewise preferably made of spring steel. Again, holding ring 46 is seated in a circumferential groove 47 provided on the exterior circumference of conical tail section 16 of projectile 10, but this groove has the advantage over groove 44 of FIG. 2 in that its overall dimensions can be kept smaller. Thus, it is possible, in a preferred embodiment of the invention, to give circumferential groove 47 a maximum depth 54 which is less than 0.9 times the cross-sectional radius 52 of holding ring 46.

Figure 4:
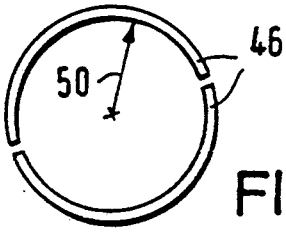
FIG. 4 is a plan view of the holding ring of FIG. 3.

Preferably, holding rings 42 (FIG. 2) and 46 (FIG. 3) are segmented in order to enhance their release behavior. FIG. 4 shows a plan view of holding ring 46, by way of example, which is divided into two segments. Without limiting the scope of the invention, it is also conceivable to have a larger number of segments. Advantageously, the holding rings have an inner diameter, marked 50 in FIG. 4, which is made slightly larger than the smallest radius in the region of the respective holding grooves 44 and 47. In this way, when a projectile 10 is inserted into receptacle 32, the segments of the respective holding ring 42 or 46 are compressed slightly so that the thus realized pretensioning additionally improves the release behavior of the holding ring segments.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A spin stabilized projectile unit, comprising:

a sub-caliber projectile having a cylindrical section with an outer diameter, a conical tail section including an external circumferential holding groove and having an outer diameter, and a transition region connecting said cylindrical section to said conical section;

a propelling cage casing enclosing said projectile; a a propelling base including a receptacle holding said projectile and being connected with said projectile and said propelling cage casing, said receptacle including inwardly projecting axial webs presenting an inner diameter of said receptacle in a region of the cylindrical section of said projectile which corresponds to the outer diameter of said cylindrical section, the inner diameter of said receptacle formed by said webs becoming increasingly larger than the respective outer diameter of said conical section beginning in said transition region to form an annular gap extending to a bottom region of said receptacle; and a holding ring, comprising at least two segments, disposed between the inner diameter of the receptacle and the outer diameter of said conical tail section and lying in said holding groove and against the inner diameter of said receptacle for holding said projectile in the receptacle of said propelling base.

2. A projectile unit as defined in claim 1, wherein said holding ring comprises spring steel.

3. A projectile unit as defined in claim 1, wherein said holding ring has an angular cross-sectional shape generally corresponding to a trapezoid having a rounded base.

4. A projectile unit as defined in claim 1, wherein the inner diameter of the receptacle of said propelling base in a region of the conical tail section of said projectile is stepped to form a shoulder at a location for resting against said holding ring.

5. A projectile unit as defined in claim 4, wherein said holding ring has a round cross-sectional shape and said holding groove, in which said holding ring lies, has a cross-sectional shape corresponding to a segment of a circle.

6. A projectile unit as defined in claim 5, wherein said holding groove has a depth which is less than 0.9 times the cross-sectional radius of said holding ring.

7. A projectile unit as defined in claim 1, wherein said conical tail section tapers radially inwardly in a direction away from said cylindrical section.

* * * * *